US011639604B1

(12) United States Patent
Smith, Jr.

(10) Patent No.: US 11,639,604 B1
(45) Date of Patent: May 2, 2023

(54) TRIANGULAR STANDING SEAM METAL ROOF PANEL AND COVER SYSTEM

(71) Applicant: McElroy Metal Mill, Inc., Bossier City, LA (US)

(72) Inventor: Charles L. Smith, Jr., Round Top, TX (US)

(73) Assignee: McElroy Metal Mill, Inc., Bossier City, LA (US)

( * ) Notice: Subject to any disclaimer, the term of this patent is extended or adjusted under 35 U.S.C. 154(b) by 0 days.

(21) Appl. No.: 17/505,430

(22) Filed: Oct. 19, 2021

(51) Int. Cl.
*E04D 3/30* (2006.01)
*E04D 3/36* (2006.01)

(52) U.S. Cl.
CPC ..... *E04D 3/30* (2013.01); *E04D 3/3607* (2013.01)

(58) Field of Classification Search
CPC ..... E04D 3/3607; E04D 3/364; E04D 3/30
See application file for complete search history.

(56) References Cited

U.S. PATENT DOCUMENTS 4,307,553 A * 12/1981 Puckett ..... E04D 3/364 52/470
4,575,983 A 3/1986 Lott, Jr. et al.
4,649,684 A 3/1987 Petree et al.
5,692,352 A 12/1997 Simpson
5,737,892 A 4/1998 Greenberg
5,737,894 A 4/1998 Simpson
6,301,853 B1 10/2001 Simpson et al.
6,354,045 B1 * 3/2002 Boone ..... E04D 3/3608 52/95
8,713,864 B1 * 5/2014 Smith, Jr. ..... E04D 3/364 52/203
8,887,464 B1 * 11/2014 Smith, Jr. ..... E04D 3/366 52/395
8,938,924 B1 * 1/2015 Smith, Jr. ..... E04D 3/362 52/395
9,206,606 B2 * 12/2015 Jaks ..... E04D 3/362
9,404,262 B1 * 8/2016 Smith, Jr. ..... E04D 3/3608

OTHER PUBLICATIONS

McElroy Metal, Inc., *MasterLok-90 Panel* (Aug. 3, 2020).
McElroy Metal, Inc., *MasterLok-FS Panel* (Dec. 7, 2020).
(Continued)

*Primary Examiner* — Andrew J Triggs
(74) *Attorney, Agent, or Firm* — Keith B. Willhelm

(57) ABSTRACT

A standing seam metal panel for a roof cover system has upstanding symmetrical sides defining lateral edges. A trough extends between the lateral edges. Each lateral edge comprises an angled portion, a vertical portion, and first and second horizontal portions. The angled portion extends upward and outward from the trough. The vertical portion extends upward from the angled portion and generally perpendicular to the trough. The first horizontal portion extends inward from the vertical portion and generally parallel to the trough. The second horizontal portion extends above, outward from, and generally parallel to the first horizontal portion. The lateral edges are formed by bends in the metal panel that define the portions of the lateral edges. The lateral edges are adapted to form a sidelap with a lateral edge of an adjacent the metal panel in the cover system. The sidelap is formed on panel clips of the cover system.

20 Claims, 13 Drawing Sheets

(56) References Cited

OTHER PUBLICATIONS

Schulte Building Systems, *TS-324 Roof System Installation Guide* (Aug. 2011).
Knudson Mfg., Inc., *KR-18 Black 2½-Inch Trapezoidal Standing Seam Roof Panel Machine*.
New Tech Machinery Corp., *Figure 102: TRQ250 Panel Profile* (2014).

* cited by examiner

TRIANGULAR STANDING SEAM METAL ROOF PANEL AND COVER SYSTEM

FIELD OF THE INVENTION

The present invention relates to metal panels and metal panel cover systems, and more particularly, to "triangular" standing seam metal roof panels and roof cover systems using the triangular standing seam metal roof panels.

BACKGROUND OF THE INVENTION

There are a wide variety of metal covers that have been used in the construction industry to provide a building's outermost barrier to wind and water. They may be manufactured to resemble wood shake, slate, shingles, clay tiles or other non-metallic cover materials and may be installed on exterior walls or on roofs. More typically, however, metal roof covers utilize rather elongated metal panels installed along the slope of a roof.

Metal panel roofs utilize various flashings and other components where the fields of a roof terminate or intersect, such as the eaves, gables, valleys, ridges, and hips of a roof. Even in roofs having many different intersecting or overlapping fields, however, the basic construction of metal panel roofs across the expanse of a roof is fairly standard. Most commonly, an array of spaced, elongated support members or "purlins" is mounted across the structural rafters of a roof substructure. The purlins run horizontally across the rafters, i.e., across the slope of the roof. Layers of insulation and various barriers may be, and for climate-controlled buildings usually are installed as well. Decking also may be provided instead of or in addition to purlins for additional support. A cover is provided by a series of rather elongated, mostly flat, interconnected metal panels.

Each cover panel is typically about a foot to three feet in width. Though they may be cut to any length, they commonly are 30 to 40 feet long and may run as long as 200 feet. Preferably, they run the length of the slope over which they are installed. The lateral edges of the panels are bent in various configurations to form upwardly extending sides and a trough in the middle. The trough is where most of the water will be shed from the roof. Adjacent panels are joined along their upwardly extending sides to create relatively narrow seams which are elevated above the trough.

The panels are laid out such that the seams run vertically, i.e., with the slope of the roof. The panels also may have one or more vertical ridges running through the trough, and it is those vertical seams and ridges that create the distinctive appearance that consumers associate with metal roofs. More importantly, however, since the seams between adjacent panels are formed a few inches above the troughs where most rain will be shed, metal panel roofs can be very resistant to leaking.

Raised-seam, metal panels may be classified according to the way they are installed. So called "through panel" or "exposed" fastener panels are installed with screws or other fasteners that penetrate through the cover panels. The panels typically are laid over a roof so that their sides overlap and form a raised, often trapezoidal shaped seam or "lap" rib. The panels then are joined together along the lap rib by, e.g., gasketed screws. Gasketed screws also are driven through the trough. Leakage around the fastener, at least initially, is not a significant problem. Over time, however, the elastomeric material from which the screw gaskets are fabricated can deteriorate, and leaks tend to develop around penetrating fasteners.

"Standing seam" covers can provide better resistance to leakage over longer periods of time and, in the eyes of many beholders, provide a more beautiful roof. In a standing seam cover, the metal panels are secured with concealed connectors or "clips" instead of unsightly and leak-prone penetrating fasteners. Most commonly, a plurality of relatively small panel clips is installed in a fairly widely spaced, array running vertically in what will become a seam line between adjacent panels. Panels then are installed between the vertical lines of clips, with the upturned seam edges of the panels abutting and mating with the clips and each other. There are no penetrations through the panels when clips are used. Moreover, all gaps between the panels and the clips are elevated well above the trough through which most water runoff occurs. Thus, standing seam panel covers provide better, longer resistance to leakage as compared to covers using screws or other "exposed" fasteners that penetrate the panels.

Providing adequate uplift resistance, however, can be a greater challenge in standing seam panel covers. That is, most damage to roof covers is caused by wind blowing over the surface of the roof. That air flow forms low pressure areas over the roof and creates an uplift force in much the same way that the wing of an aircraft creates lift forces. While such forces are essential for flight, the uplift forces created by powerful winds over a roof can peel metal panels or other roof coverings away from the roof. It is relatively easy to provide a sufficient number of fasteners in exposed fastener covers. Since they are connected only along their seam lines, however, providing a sufficiently secure connection for panels in a standing seam cover is more problematic.

In addition, not all parts of a roof experience the same uplift forces in a given wind. The exposed edges of a roof experience greater uplift forces, and a given surface or field of a roof may be divided into three zones in recognition of such differences. The "edge" zones include those areas within a certain distance, usually around 8 feet, of an eave or gable. If the pitch of a roof is greater than 2 inches per foot of slope, the areas adjacent the ridge and hip of the roof also are considered "edge" zones. The edge zones experience greater wind uplift pressures than most of the roof and typically constitute approximately 15% of a roof's surface. The greatest uplift pressures, however, are in the "corner" zones. Those are the areas where edge zones overlap, and they typically constitute approximately 5% of the surface of a roof. The "field" zone is the rest of the roof field, and it constitutes approximately 80% of the roof surface. The field zone experiences the lowest wind uplift pressures. In any event, providing sufficient resistance to wind uplift has been an increasingly important consideration in roof design as property owners and insurers seek to minimize their potential losses from wind damage, especially in hurricane prone areas like the Gulf and lower Atlantic coast.

There are many conventional systems that use non-penetrating clips with standing seam metal panels. In new installations, the clips often are mounted to an array of spaced, elongated support members or "purlins" which are mounted across the structural rafters of a roof substructure. The purlins run horizontally across the rafters, i.e., across the slope of the roof. In other roofs, the clips may be mounted to decking installed on the roof substructure.

Such systems are disclosed in U.S. Pat. No. 4,575,983 to H. Lott, Jr. el al. Panel clips are mounted to purlins, and the metal panels secured to the clips. The panels disclosed therein are asymmetrical standing seam panels. Asymmetrical panels have mating male-female connections, each panel having a male connection formed in one side and a female connection formed in its other side. Thus, installation must proceed in a certain direction across the roof, and removal for repair must proceed in the opposite direction.

Symmetrical standing seam panels, however, have sides that are mirror images of each other and are joined with a separate seam cover. Symmetrical panels, therefore, may be installed in either direction. A damaged panel also may be removed for replacement without removing any adjacent panels. Examples of symmetrical standing seam roof covers where non-penetrating individual clips are mounted to purlins are disclosed in U.S. Pat. No. 4,649,684 to L. Petree et al. Other covers, such as those disclosed in U.S. Pat. No. 6,354,045 to M Boone et al. and U.S. Pat. No. 5,737,892 to P. Greenberg, utilize individual and elongated, "continuous" clips that are mounted to and span adjacent purlins. While they may be more expensive than covers using asymmetrical panels, such symmetrical panel covers can offer improved leak protection, better uplift resistance, and longer service life.

Metal roof panels most commonly are fabricated from relatively thin metal coiled sheets. A coiled metal sheet is run through a roll former to provide the lateral edges of the panel with the geometry or "profile" required for forming seams between panels. Any desired vertical or horizontal ridges running through the trough are formed along with the shaping of the lateral edges. Necessarily, then, the resulting panel is thin and very flexible.

Seams between adjacent panels and ridges in the trough provide some resistance to flexing. When a cover is installed on an array of purlins, however, the panels will extend across the spacing between the purlins, typically from about 2.5 to about 5 feet. Many conventional panels will flex under load, for example, load created when a person walks across the panel. Load may be supported, but flexing of the panel creates a feeling of insecurity in persons traversing the cover. Flexing also can damage the seams. Even if the seams are not damaged, flexing over time can lead to "telegraphing" of the purlins. That is, subtle bending of the panels where they cross over purlins becomes visible and detracts from the aesthetics of the cover. Such issues are exacerbated as the roof becomes flatter.

Flexing may be reduced or essentially eliminated by installing the cover over a deck. Indeed, for architectural roof panels, a deck is typically required. Architectural metal panels are generally installed over relatively steep roofs, those having a minimum slope of about 3 inches per foot of slope. The roof surfaces being more visible, aesthetics may be more valued. The panel seams in architectural metal panel roofs are hydrokinetic, i.e., water shedding, and are relatively short, usually 0.5 to 1.5 inches high. The profile of architectural panels also typically is less complicated and dramatic. Thus, the panels may be formed more easily. Installing the required supporting deck, however, adds significantly to the cost of the roof cover. Adding more purlins and decreasing their spacing may be an option, but that too adds significant cost.

Thus, structural metal panels are most commonly used over flat and relatively low slope roofs, recognizing that even "flat" roofs preferably have a minimum of 0.25 inch per foot of slope to provide runoff. A structural panel roof cover is designed to support weight without a deck. They may be installed on an array of relatively widely spaced purlins. The panels, therefore, have a more complicated, dramatic profile. The seams are significantly higher than in architectural panels, usually about 3 inches high. A greater number of bends also typically is required to provide the panel with a more load-resistant profile. Since ponding water is a potential issue in flat and low-slope roofs, especially over time as settling of the structure may occur, the seams of a structural cover also are hydrostatic, that is, water-tight.

So-called trapezoidal standing seam panels are common examples of structural metal roof panels that provide significant resistance to flexing. Panels of this type are available commercially from a number of manufacturers, such as the Masterlock FS mechanically-seamed panels sold by McElroy Metal Mill, Inc., Bossier City, La. Other types of trapezoidal, standing seam metal panels are available as well, including so-called "snap-in" panels, such as the Masterlock standing seam panels produced by McElroy Metal, and "hook and roll in place" panels such as those disclosed in U.S. Pat. Nos. 5,692,352, 5,737,894, and 6,301,853 to H. Simpson et al. and the TS-324 metal panel system licensed by Building Research Systems, Inc. to Schulte Building Systems and other manufacturers.

An exemplary conventional trapezoidal standing seam metal panel 120 is shown in FIGS. 1 and 2. As may be seen in FIG. 1, panel 120 is generally elongated and has sides 123 that define a trough 122 running longitudinally through panel 120. Smaller vertical ridges 126 run longitudinally through trough 122. Sides 123 are formed by various bends in the lateral edges of panel 120 as seen best in FIG. 2. Panel 120 is bent upward from trough 122 first at a relatively shallow angle and then at a relatively steep angle. The two angled portions lead into a horizontal extension running generally parallel to the trough. Additional bends are formed beyond the horizontal extension. Those bends provide the portions that overlap and are formed into standing seams 121 between adjacent panels as shown in FIG. 2. Standing seams 121 are formed and supported on clips 130 that are mounted on purlins 61. When adjacent panels are seamed, a relatively wide, vertical beam 124 is created. Along with standing seams 121 and vertical ridges 126, vertical beams 124 provides panels 120 with substantial resistance to flexing.

The geometry that provides its resistance to flex, however, imposes significant limitations on the fabrication of trapezoidal standing seam panels. Their profile is more complex and more dramatic than that of other, albeit more flexible standing seam panels such as architectural panels. Architectural panels may be fabricated with smaller roll formers that may be transported to a job site. Since it is formed on site, the panel may be fabricated in much longer lengths, up to 200 feet or more. That will allow the panels in most cases to extend the entire length of the slope over which they are installed. Potentially problematic end laps in a run are usually avoided.

Creating the more complex and dramatic profiles in conventional trapezoidal standing seam panels, however, is more difficult. More, and more pronounced bends must be formed in the panel. As a practical matter, trapezoidal standing seam metal panels must be formed by heavy, more complex and capable, fixed-base roll formers. Such roll formers are extremely difficult to transport, and rarely, if ever, are moved from job site to job site. Given the number of bends, it also a more difficult to maintain consistent fabrication of panels to specification.

Consequently, virtually all conventional trapezoidal standing seam metal panels are fabricated in the factory and are cut to a transportable length, typically from about 40 to about 50 feet. Panels of those lengths, however, do not always cover the entire slope. It may be necessary to use several panels for a run, and end laps may have to be provided between the panels. Such end laps are potential sources of leaking and are more susceptible to wind uplift.

Moreover, even when produced to specification, it is more difficult to install conventional trapezoidal standing seam panels with proper modularity. That is, during installation, the specified width of the panels must be maintained as they are seamed along their lateral edges. Many conventional trapezoidal standing seams, however, because of their profile and the bends therein, tend to expand and contract laterally—in an accordion-like fashion—as they are installed. That makes it more difficult to install panels to specification, that is, to maintain modularity through the cover. The width of a panels may end up being different at one end than at the other, or in the mid-section of the panel. The width of the sidelap also can deviate significantly off specification. Such variation, or lack of modularity can detract significantly from the appearance of the cover. It also can create problems in finishing the cover along eaves, ridges, gables, and the like.

The statements in this section are intended to provide background information related to the invention disclosed and claimed herein. Such information may or may not constitute prior art. It will be appreciated from the foregoing, however, that there remains a need for new and improved standing seam metal roof panels and metal panel cover systems. Such disadvantages and others inherent in the prior art are addressed by various aspects and embodiments of the subject invention.

SUMMARY OF THE INVENTION

The subject invention, in its various aspects and embodiments, is directed generally to standing seam metal roof panels and to metal panel roof covers. One aspect and embodiment of the invention provides for a standing seam metal panel for a roof cover system. The metal panel comprises upstanding symmetrical sides. The sides define lateral edges. A trough extends between the lateral edges. Each lateral edge comprises an angled portion, a vertical portion, and first and second horizontal portions. The angled portion extends upward and outward from the trough. The vertical portion extends upward from the angled portion and generally perpendicular to the trough. The first horizontal portion extends inward from the vertical portion and generally parallel to the trough. The second horizontal portion extends above, outward from, and generally parallel to the first horizontal portion. The lateral edges are formed by bends in the metal panel, the bends thus defining the portions of the lateral edges. The lateral edges are adapted to form a sidelap with the lateral edge of an adjacent the metal panel in the cover system. The sidelap is formed on panel clips of the cover system.

Other aspects provide such panels where the lateral edge angled portion of the panel extends from the trough at an angle of from about 30 to about 60°, or at an angle of from about 40 to 50°, or at an angle of about 45°.

Still other aspects provide such panels where the first and second lateral edge horizontal portions are doubled over to form a U-shaped channel that is adapted to receive a support portion of the panel clips of the cover system.

Further aspects provide such panels where the metal panel comprises a ridge running longitudinally through the trough or where the metal panel comprises two or more such ridges.

In other aspects and embodiments, the invention provides for a cover system. The cover system comprises a plurality of panel clips and a metal panel cover attached to the panel clips. The panel clips are attached to a support and arranged in linear arrays running along the pitch of the cover system. The metal panel cover comprises a plurality of the novel metal panels that are interconnected along adjacent lateral edges by sidelaps formed on the panel clips. The sidelaps extending along the pitch of the cover system.

Other aspects provide such cover systems where the cover system comprises an array of spaced purlins providing the support. The purlins run across the pitch of the cover system and the plurality of panel clips are attached to the purlins.

Still other aspects provide such cover systems where the cover system comprises fibrous batts or other insulation disposed between the support and the metal panel cover.

Yet other aspects provide such cover systems where the panel clips are individual panel clips, where the panel clips are continuous panel clips, where the panel clips include individual panel clips installed in a field zone of the cover system and continuous panel clips installed in an edge zone of the cover system, or where the panel clips include individual panel clips installed in a field zone of the cover system and continuous panel clips installed in a corner zone of the cover system.

In other aspects and embodiments, the invention provides for a metal panel standing seam roof recover system installed over an existing cover of a roof cover system. The recover system comprises a plurality of panel clips and a metal panel recover attached to the panel clips. The panel clips are attached to the existing cover system and arranged in linear arrays running along the pitch of the roof recover system. The metal panel recover comprises a plurality of the novel metal panels that are interconnected along adjacent lateral edges by sidelaps formed on the panel clips. The sidelaps extend along the pitch of the recover system.

Other aspects provide such recover systems where the recover system comprises rigid foam insulation boards or other insulation disposed between the existing cover system and the metal panel cover.

Still other aspects provide such recover systems where the existing cover system is a metal panel cover system or a shingled cover system.

Yet other aspects provide such recover systems where the existing cover system comprises a support frame having an array of spaced purlins running across the pitch of the existing cover system and the plurality of panel clips are attached to the purlins.

Further aspects provide such recover systems where the panel clips are individual panel clips, where the panel clips are continuous panel clips, where the panel clips include individual panel clips installed in a field zone of the existing cover system and continuous panel clips installed in an edge zone of the existing cover system, or where the panel clips include individual panel clips installed in a field zone of the existing cover system and continuous panel clips installed in a corner zone of the existing cover system.

In other aspects and embodiments, the invention provides methods of installing a standing seam metal panel roof cover system. The method comprises installing a plurality of panel clips and attaching a plurality of the novel panels to the panel clips. The panel clips are installed on an array of spaced purlins running across the pitch of the cover system and in linear arrays running along the pitch of the cover system. The metal panels are attached to the panel clips by forming the sidelaps on the panel clips.

Other aspects provide such methods where the panel clips are individual panel clips, where the panel clips are continuous panel clips, where the panel clips include individual panel clips installed in a field zone of the cover system and continuous panel clips installed in an edge zone of the cover system, or where the panel clips include individual panel clips installed in a field zone of the cover system and continuous panel clips installed in a corner zone of the cover system.

Finally, still other aspects and embodiments of the invention will provide such panels, cover and recover systems, and methods having various combinations of such features as will be apparent to workers in the art.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the claims set forth herein.

Figure 1:
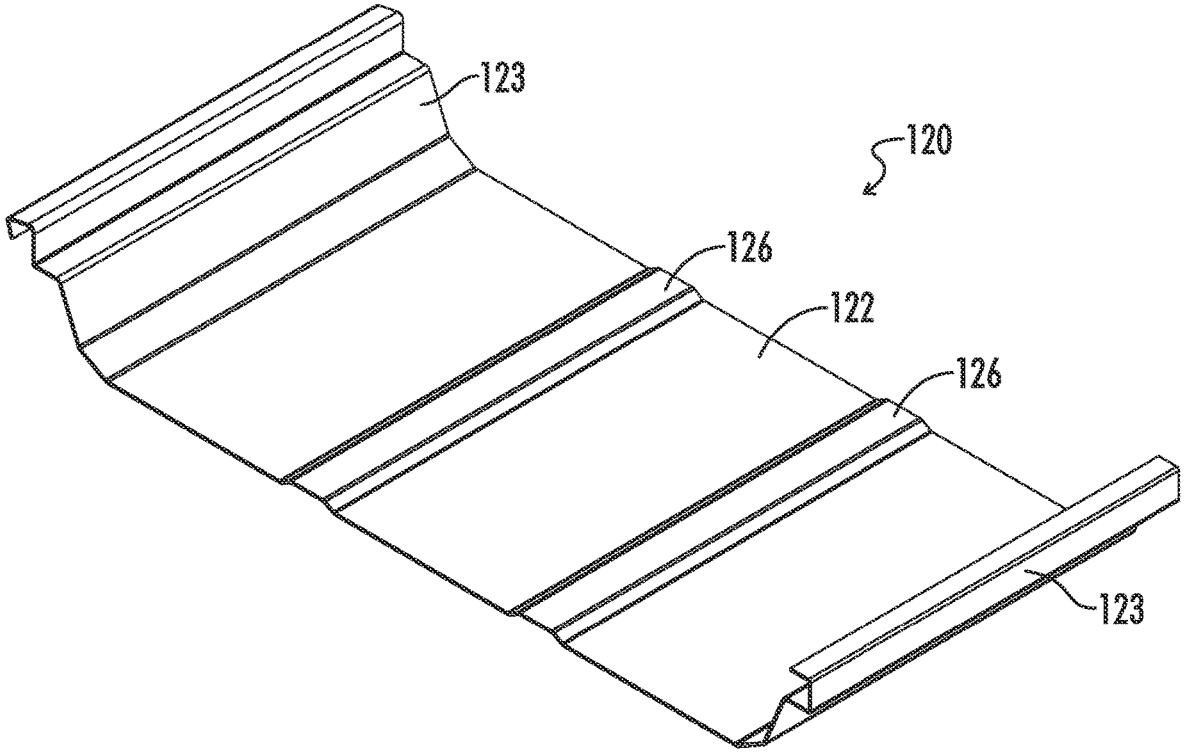
FIG. 1 (PRIOR ART)
FIG. 1 (prior art) is an isometric view of a conventional trapezoidal standing seam metal roof panel 120.
Figure 2:
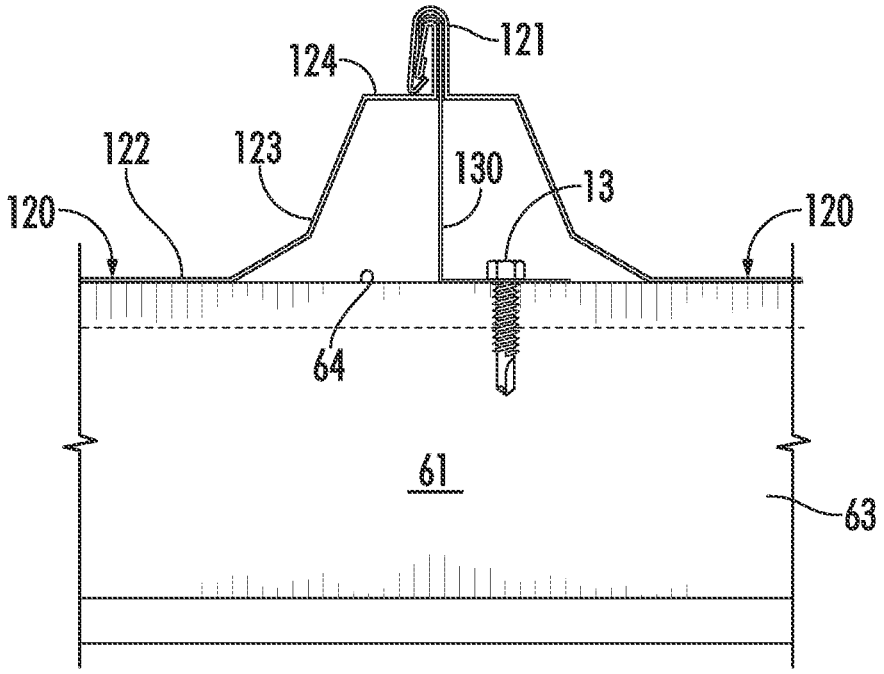
FIG. 2 (PRIOR ART)
FIG. 2 (prior art) is an enlarged cross-sectional view of a standing seam 121 formed between two conventional metal panels 120 shown in FIG. 1, which view is taken generally perpendicular to standing seam 121.

In the drawings and in the description that follows, like parts are identified by the same reference numerals. The drawing figures are not necessarily to scale. Certain features of the invention may be shown exaggerated in scale or in somewhat schematic form and some details of conventional design and construction may not be shown in the interest of clarity and conciseness.

DESCRIPTION OF ILLUSTRATIVE EMBODIMENTS

The present invention generally relates to standing seam metal roof panels and to metal panel roof covers. Various preferred embodiments of the novel roof panels have upstanding symmetrical sides defining lateral edges. A trough extends between the lateral edges. The lateral edges, as described further below, have bends that define edge portions. The edge portions provide the lateral edges with a geometry that allows the lateral edges to form a seam or sidelap with the lateral edge of an adjacent panel. Preferred embodiments of the novel roof covers comprise a plurality of the novel metal roof panels that are interconnected along adjacent lateral edges by sidelaps formed on a plurality of fixed panel clips.

For example, a first preferred embodiment 10 of the novel metal panel roof covers and components thereof are shown in FIGS. 3-10. As best appreciated from FIGS. 4-6, novel roof cover 10 generally comprises a plurality of a first preferred embodiment 20 of the novel metal roof panels, individual clips 30, continuous clips 40, and purlins 61.

Figure 7:
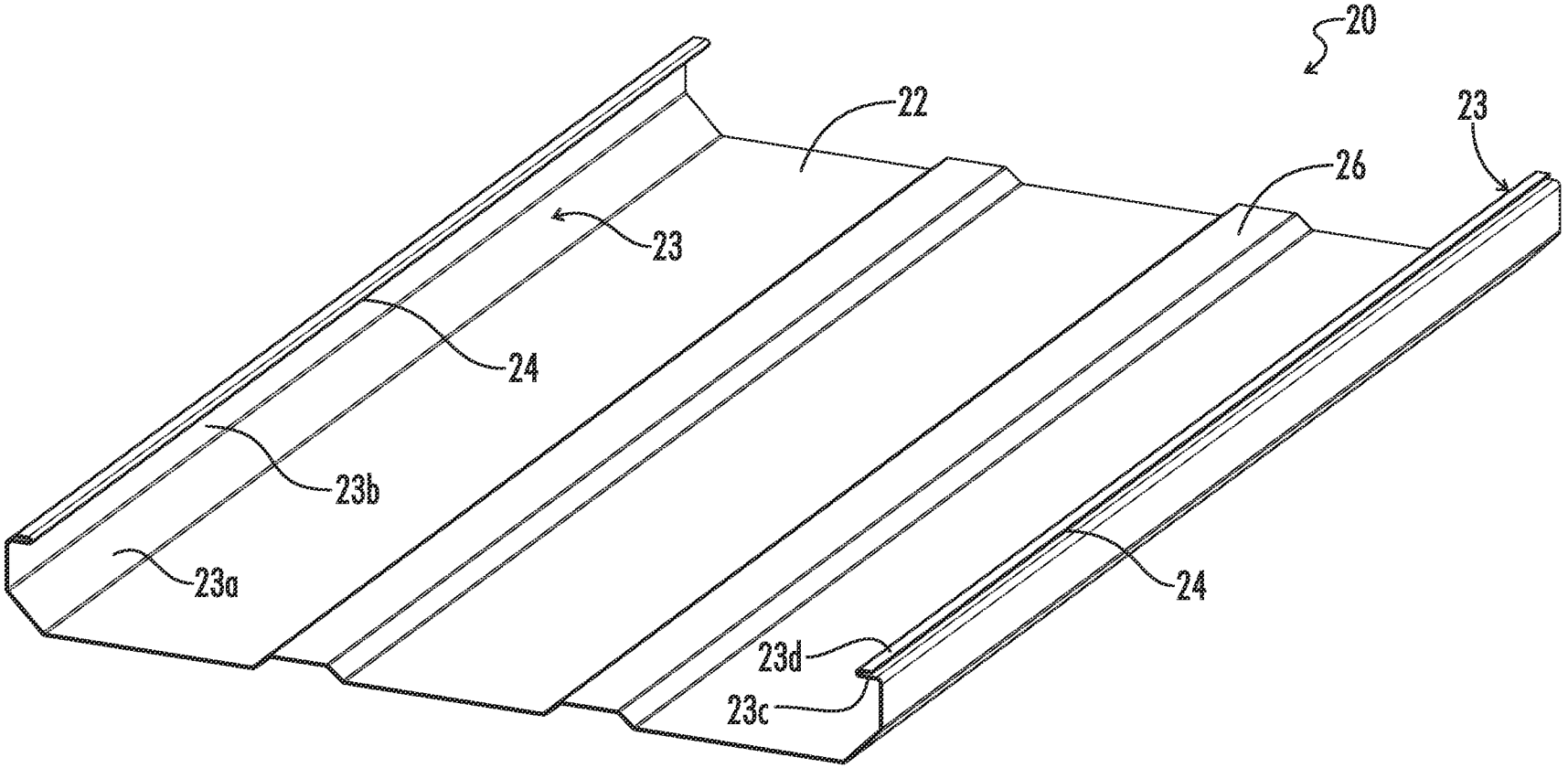
FIG. 7 is an isometric view of a preferred embodiment 20 of the novel "triangular" standing seam metal roof cover panels of the subject invention, metal panel 20 being used in novel roof cover 10 shown in FIGS. 3-6.
Figure 8:
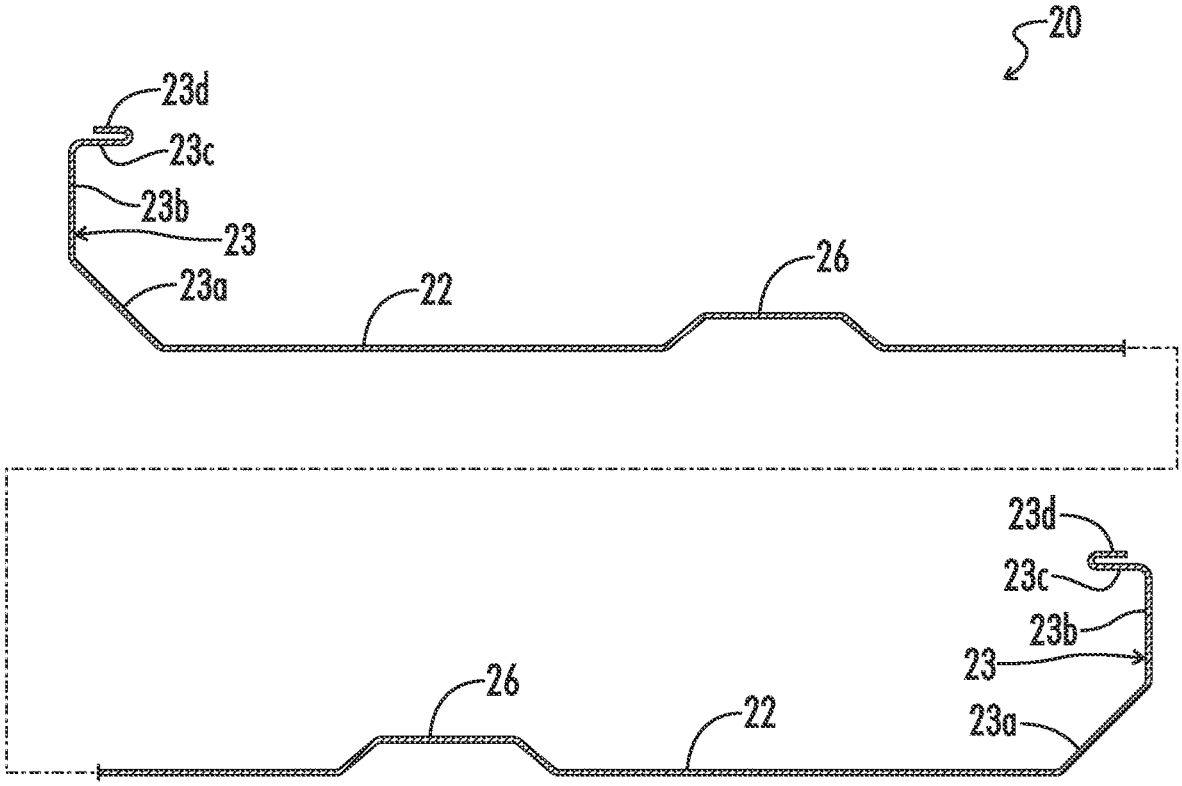
FIG. 8 is a lateral cross-sectional view of novel metal panel 20 shown in FIG. 7.

Novel panel 20, as seen best in FIGS. 7-8, has upturned sides 23 that provide lateral edges running along the length of panel 20. A trough 22 extends between sides 23. Preferably, ridges are provided in trough 22, such as ridges 26 that extend lengthwise or vertically through trough 22. Horizontal ridges also may be provided in trough 22 if desired. Sides 23 are bent to provide them with a geometry that allows them to be joined to form a seam or sidelap 21 between adjacent panels 20 in roof cover 10, as will be described further below. Sidelaps 21 are elevated above trough 22, and thus, most of the water falling on roof cover 10 will be shed through troughs 22.

Novel panel 20 is referred to as a symmetrical panel. That is, sides 23 of panel 20 are mirror images of each other. Panels 20 also are standing seam panels. That is, as described further below, sidelaps 21 between adjacent panels are formed on clips 30 and 40 without the use of penetrating fasteners. When panels 20 are joined by sidelaps 21 and viewed in cross-section as in FIGS. 5-6, sides 23 form what may be viewed as a bisected triangular shape, the base of which is an imaginary line extending along the plane of trough 22. Thus, and in contradistinction to so-called "trapezoidal," asymmetrical standing seam metal panels such as prior art panel 120, novel panels 20 may be referred to as "triangular," symmetrical, standing seam, metal panels.

Figure 3:
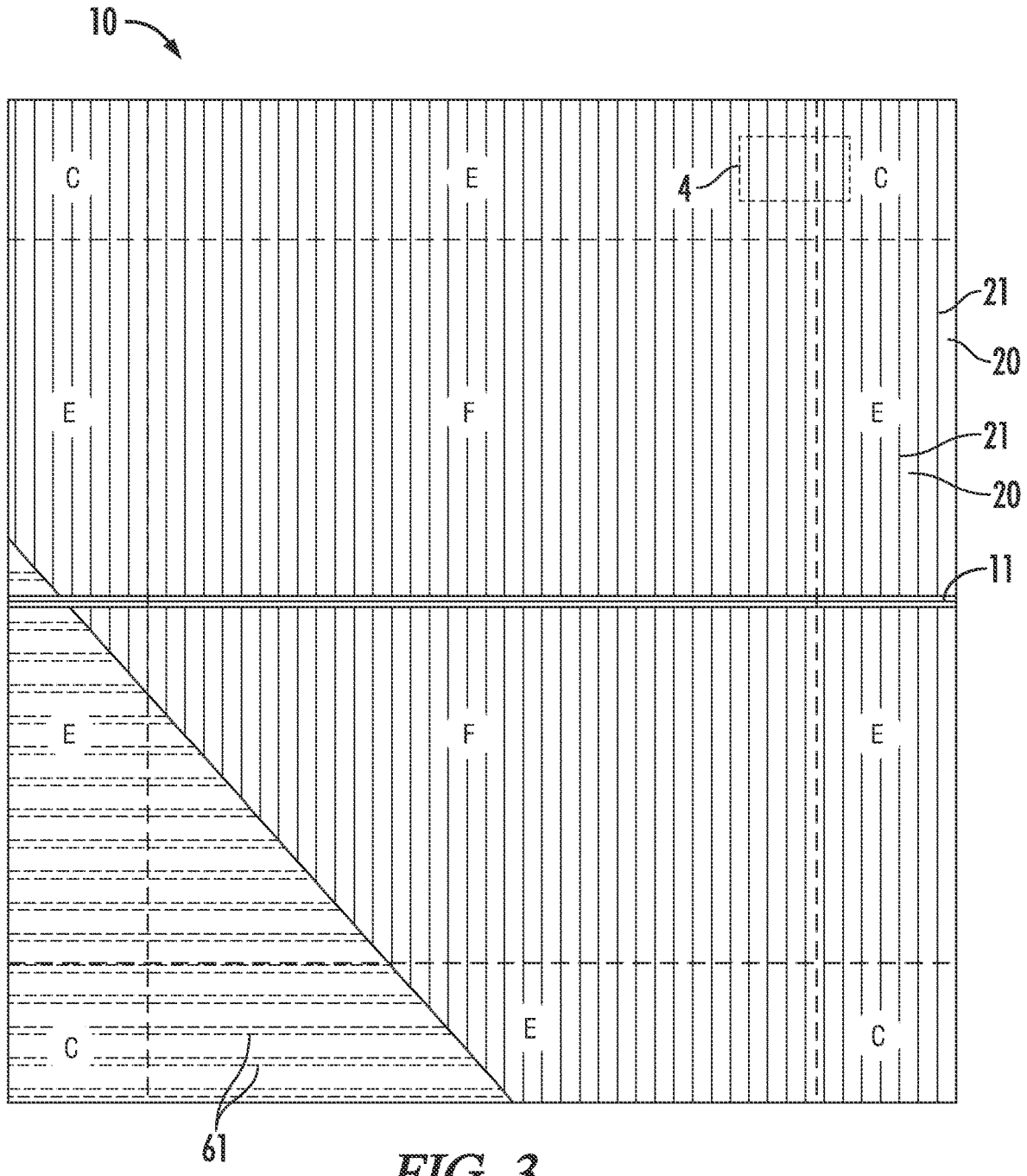
FIG. 3 is a plan view, having partial tear-away views, of a first preferred embodiment 10 of the novel roof covers of the subject invention.
Figure 4:
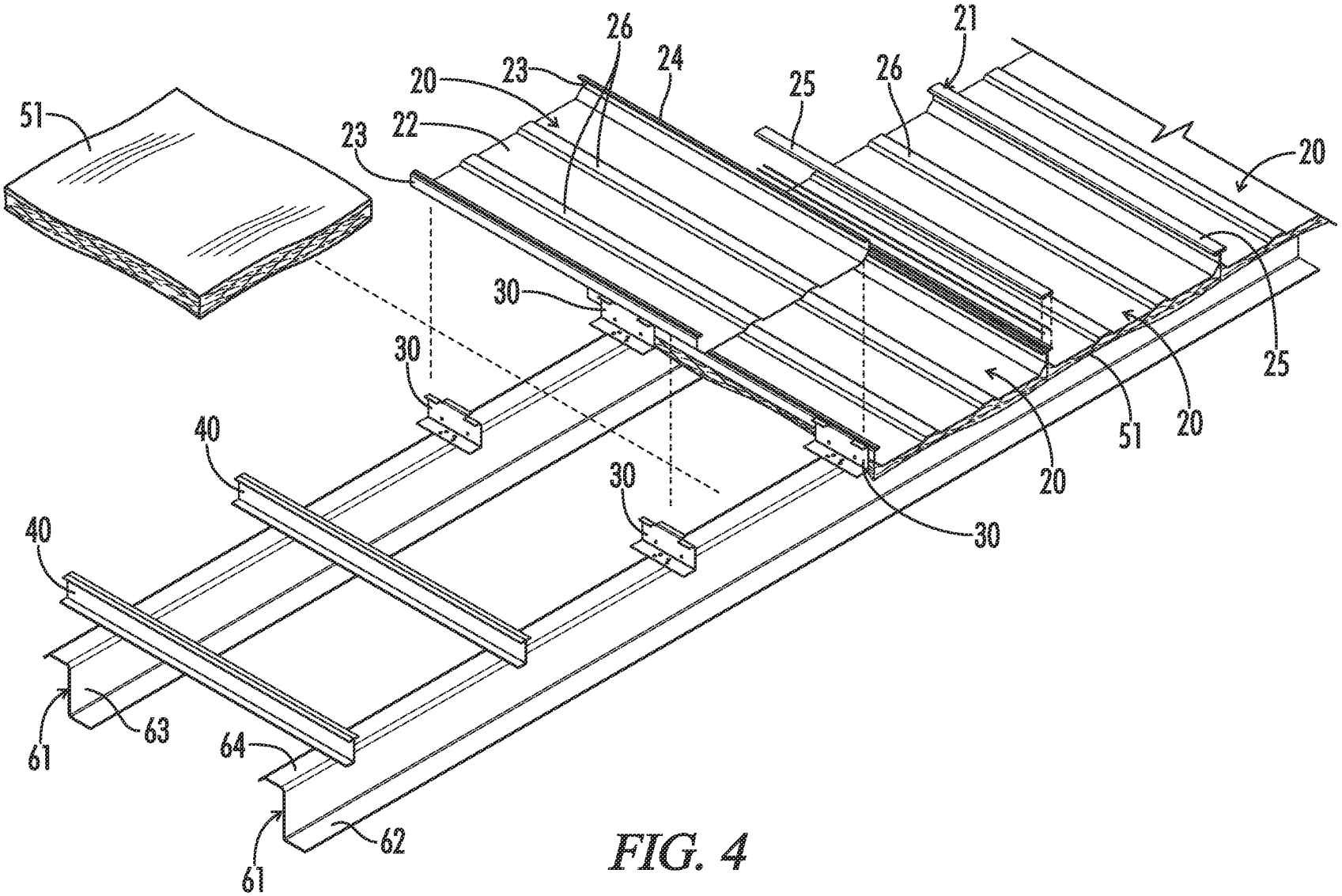
FIG. 4 is a perspective, partially exploded view of a portion of novel roof cover 10 taken generally from an area 4 of FIG. 3, which portion has been installed across a boundary between edge zone E and corner zone C of roof cover 10 (certain components of novel roof cover 10 having been omitted therefrom).

As shown in FIGS. 3-4, panels 20 in roof cover 10 are installed on a support frame that comprises an array of spaced, elongated bar joists or purlins 61. Purlins 61 are mounted on structural rafter beams (not shown) of a roof substructure and run "horizontally" through the roof. That is, purlins 61 are installed and run across the slope of a roof, as opposed to running "vertically" or with the slope. Panels 20 are installed such that they, and sidelaps 21 joining adjacent panels 20 run vertically across purlins 61. The upper ends of panels 20 extend under a ridge cap 11 provided along a peak line of roof cover 10. Preferably, each panel 20 runs down the entire slope of roof cover 10 to an eave or valley (not shown). Alternately, panels 20 may be overlapped at their ends.

Purlins 61 may be any type of elongated support member, but are exemplified herein as "Z" purlins of the type widely used in metal roofs and building covers. As seen best in FIG. 4, purlins 61 have a flange 62 extending generally horizontally in one direction from the lower end of a vertically oriented body 63. Another flange 64 extends generally horizontally in the other direction from the upper end of body 63. Lower flange 62 provides a base by which purlins 61 are attached to the rafter beams (not shown). Upper flange 64 provides a surface upon which is mounted roof cover 10. Lower flange 62 and upper flange 64 also preferably and typically are provided with angled edges to provide greater structural integrity and strength to purlin 61.

Figure 5:
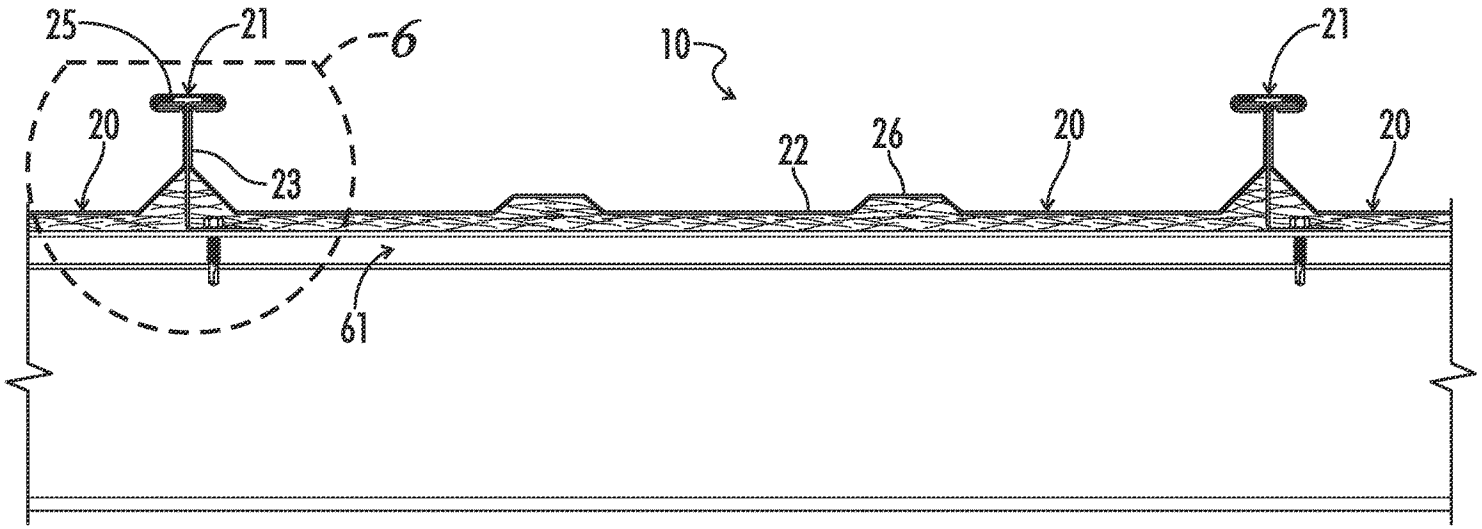
FIG. 5 is a cross-sectional view taken generally perpendicular the vertical planes of standing seams 21 of novel roof cover 10 shown in FIG. 4.
Figure 6:
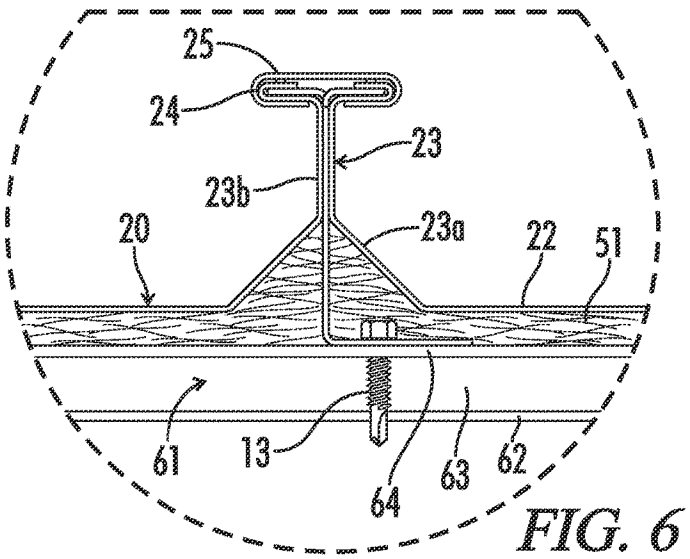
FIG. 6 is an enlarged, detailed view of portion 5 of the view shown in FIG. 5.

Panel clips are used to secure the novel panels to the cover support and to facilitate the formation of standing seams between the panels. Individual clips 30 and continuous clips 40, for example, are used to secure cover panels 20 to purlins 61 and to facilitate the formation of seams 21 between laterally adjacent panels 20 as shown in FIGS. 4-6. They are arranged in linear arrays running vertically across purlins 61. Clips 30 and 40 are attached to purlins 61 by fasteners, such as self-tapping metal screws 13 shown in FIGS. 5-6.

Preferred embodiments of the subject invention include metal panel roof covers in which individual panel clips are installed in the field of the roof cover and continuous clips are installed in corner zones, and where either individual or continuous clips are installed in edge zones of the roof cover. For example, novel roof cover 10 includes large field zones F, edge zones E, and corner zones C as shown in FIG. 3. Individual panel clips 30 are installed in field zones F and edge zones E and continuous clips 40 are installed in corner zones C. That may be best appreciated by reference to FIG. 4, which is a section 4 of novel roof cover 10 installed across a boundary between an edge zone E and a corner zone C.

As exemplified therein, individual clips 30 are mounted on purlins 61 in linear arrays. The arrays of individual clips 30 run vertically through field zones F and edge zones E of roof cover 10 along what will become the seam lines for cover panels 20. Thus, the linear arrays of clips 30 are separated horizontally by a distance substantially equal to the width of cover panels 20.

Continuous clips 40 are installed in corner zones C of roof cover 10. Like individual clips 30, continuous clips 40 are mounted along what will become seam lines for cover panels 20. Thus, they too are offset from each other by a distance approximately equal to the width of panels 20. In contrast to individual clips 30, however, continuous clips 40 are elongated and extend across adjacent purlins 61. Continuous clips 40, therefore, provide continuous support for panels 20 through corner zones C, thus providing greater resistance to wind uplift in those areas experiencing the greatest uplift forces.

If desired or necessary, increased resistance to wind uplift may be provided in roof edge zones E by providing continuous clips in those zones instead of individual clips as in roof cover 10. Similarly, in the zones where they are employed, individual clips typically will be installed on every purlin along the seam line as are clips 30 in roof cover 10. If resistance to wind uplift is not a great concern, however, it may not be necessary to install an individual clip on every purlin. It also will be appreciated that continuous clips preferably extend across the entire corner zones or, if employed therein, the edge zones of a roof. Shorter continuous clips may be employed, however, and arranged in a line across the zone such that their ends overlap, abut, or are spaced somewhat apart with the result that support for recover panels is provided across substantially the entire run through the zone. Similarly, if desired, resistance to wind uplift, as well as rigidity may be maximized by using continuous clips across the entire cover. In any event, by selectively installing either individual or continuous clips across the roof, it is possible to provide a standing seam roof cover with increased resistance to wind uplift in those areas requiring greater resistance, yet which requires fewer parts, may be installed more easily, and has lower material costs.

Figure 9:
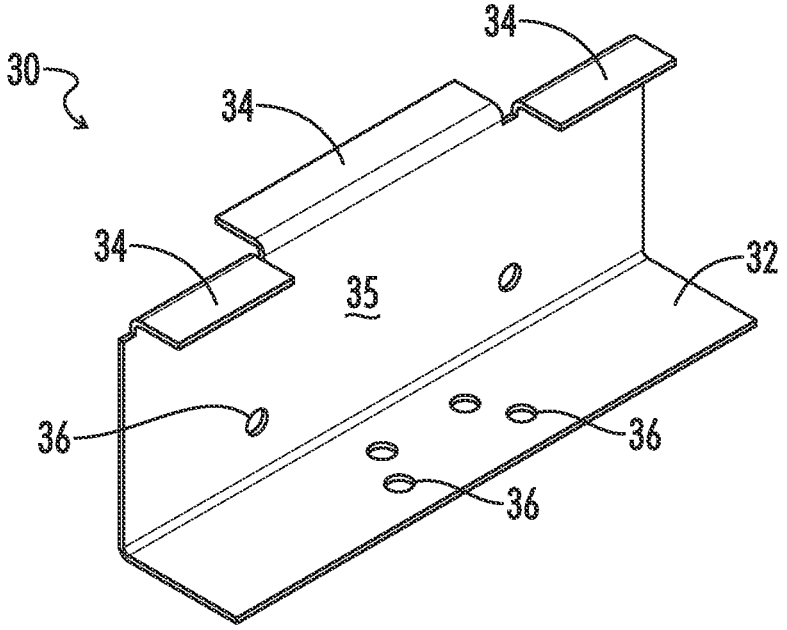
FIG. 9 is an isometric view of an individual panel clip 30 used in novel roof cover 10 shown in FIGS. 3-6.

As seen best in FIG. 9, individual clips 30 in field zones F and edge zones E include a bottom flange or base 32 and top flanges 34 that extend generally horizontally from a vertically oriented web or body 35. Individual clips 30 are attached to purlins 61 by fasteners, such as self-tapping, metal screws 13, extending through bottom flange 32 of clips 30 and top flange 64 of purlins 61. Preferably, preformed round apertures 36 are provided in base 32 of individual clips 30 to accommodate screws 13 or other fasteners. If desired, however, slots may be provided, or screws may be driven through base 32.

It will be appreciated that a greater or lesser number of screws 13 or other fasteners may be used to mount individual clips 30 to purlins 61. Typically, at least two fasteners will be used to resist torque about the connections and to provide greater stability for individual clips 30. Additional screws 13 or other fasteners may be used when more stability and strength is required in the connection between individual clips 30 and purlins 61.

The length of clips 30 and base 32 thereof, as well as the placement, configuration, and number of apertures 36, preferably are coordinated to allow for some imprecision in placement of clips 30 during installation while ensuring that a sufficient number of fasteners may be driven into purlins 61. It also is preferable that individual clip 30 and base 32 be sufficiently long so as to allow for a more stable and secure connection to purlins 61.

Top flanges 34 provides support for cover panels 20 and facilitate the formation of standing seams 21 between cover panels 20. As mentioned previously, the lateral edges of panels 20 are bent upwards to provide upwardly extending sides 23 on both sides of trough 22. More specifically, and as best appreciated from the cross-sectional views of FIGS. 5-6 and 8, sides 23 comprise an angled portion 23*a*, a vertical portion 23*b*, a first horizontal portion 23*c*, and a second horizontal portion 23*d*, all formed by bends in panel 20 and running the length of panel 20. Angled portion 23*a* extends upward and outward from trough 22. Vertical portion 23*b* extends upward from angled portion 23*a* and generally perpendicular to trough 22. First horizontal portion 23*c* extends inward from vertical portion 23*b* and generally parallel to trough 22. Second horizontal portion 23*d* extends above, outward from, and generally parallel to first horizontal portion 23*c*. First and second horizontal side portions 23*c* and 23*d* are doubled over horizontally to form a narrow U-shaped channel 24 that runs vertically along the top of each side 23 of panels 20. It will be noted again that sides 23 are mirror images of each other, thus providing panel 20 with a longitudinal plane of symmetry.

As recover panels 20 are installed, U-shaped channels 24 in the upper portion of sides 23 of panels 20 are slipped over top flanges 34 of clips 30. A seam cover 25 then is provided over and around side portions 23*c* and 23*d*, that is, the exterior of channel 24 to secure panels 20 to each other and to clips 30. Preferably, a sealant, such as a bead of silicone caulk or elastomeric tape, is provided between seam cover 25 and the exterior of channels 24 to enhance the weather tightness of seams 21. A seamer also may, and preferably is used to securely connect and seal seam cover 25 to panel sides 23.

The exact dimensions of top flanges in the individual clips are not especially critical and may be varied somewhat to provide as much or as little support surface as may be desired or necessary for a particular installation. Likewise, clips 30 have three top flanges 34, two flanges 34 extending in one direction and one flange 34 extending in an opposite direction. Other clips, however, may be provided with any number of top flanges extending in alternating directions.

Figure 10:
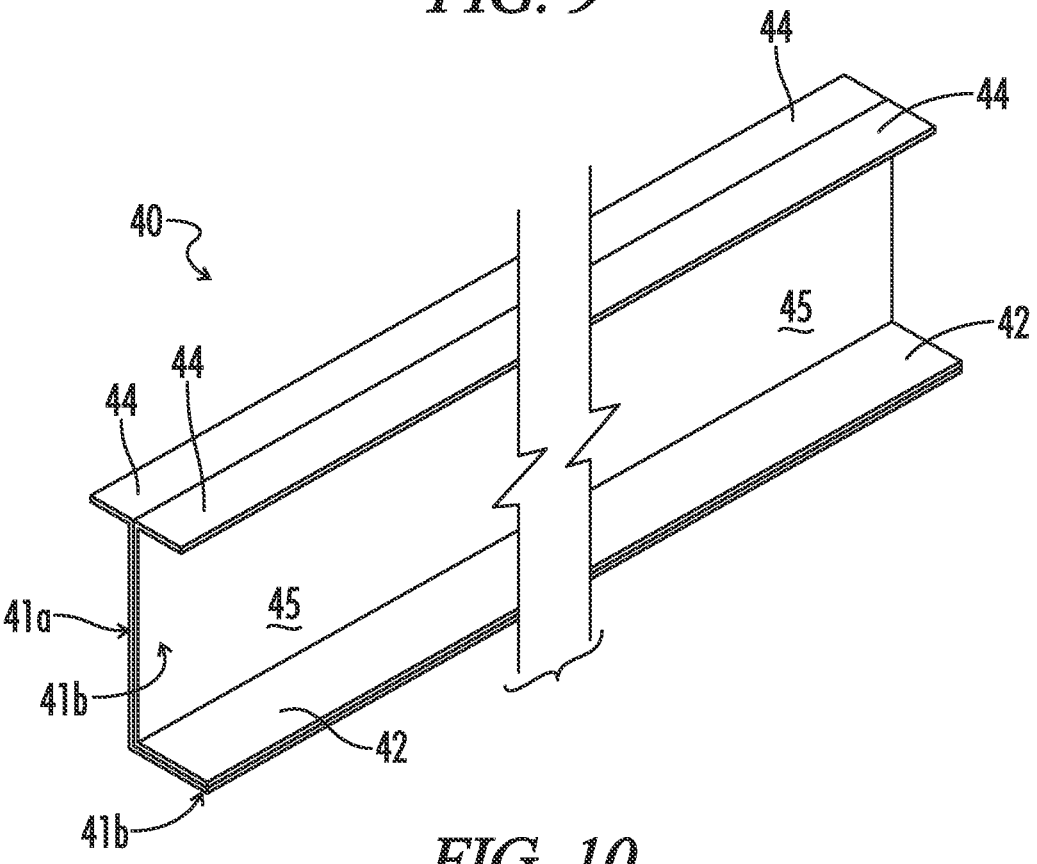
FIG. 10 is an isometric view of a first continuous panel clip 40 used in novel roof cover 10 shown in FIGS. 3-6.

Continuous clips 40, as seen best in FIG. 10, are formed from two similar, nesting components 41*a* and 41*b*. More particularly, clip components 41 have a bottom flange 42 and a top flange 44 extending generally horizontally from a vertically oriented web or body 45. They are substantially identical except that top flange 44 of clip component 41*a* and top flange 44 of clip component 40*b* extend in opposite directions. Body 45 of clip component 41*b* also is slightly shorter than body 45 of clip component 41*a*, such that when clip components 41 are nested together, their top flanges 44 will be substantially aligned.

Continuous clips 40 are attached to purlins 61 in a manner similar to individual clips 30. Fasteners, such as self-tapping, metal screws, may be driven through bottom flanges 42 of clips 40 and top flange 64 of purlins 61. As with individual clips 30, a greater or fewer number of fasteners may be used as required to provide the necessary strength of connection. Continuous clips 40, because of their extended length, typically will be fabricated from lighter gauge metal, and thus, self-tapping metal screws typically can be driven easily through them during installation. If desired, however, prefabricated apertures, slots, and the like may be provided therein to accommodate screws or other fasteners.

The length of clip components 41 is coordinated such that clips 40 span at least the distance between adjacent purlins 61, but preferably such that clips 40 extend across all purlins 61 in the corner zone of roof cover 10. The width of base 42, as well as the placement, configuration, and number of any apertures present, preferably are coordinated to allow for some imprecision in placement of clip components 41 during installation while ensuring that a sufficient number of fasteners may be driven into purlins 61.

Top flanges 44 of continuous clips 40, similar to top flanges 34 in individual clips 30, engage adjacent panels 20 and assist in the formation of standing seams 21 therebetween. More particularly, top flanges 44 are configured such that sides 23 of panels 20 may be engaged therewith by slipping U-shaped channels 24 around top flanges 44. Seam cover 25 then is placed over and around channels 24 to secure panels 20 to each other and to continuous clips 40. Sealants and seamers also are preferably used to form a secure, weather tight seam along continuous clips 40.

The clips used in the novel metal panel roof recovers preferably are made from steel, such as 16 to 24-gauge galvanized steel sheets that may be easily formed and bent and cut into a desired configuration by conventional metal forming equipment. Such materials provide a rugged, weather resistant clip that may be manufactured easily and economically. Continuous clips, given their length, may be made from somewhat lighter gage metal if desired to reduce costs and to allow screws to be driven more easily through the clip instead of providing apertures to accommodate fasteners. Other metals, such as extruded aluminum, may be used to fabricate the panel clips, however, as well as rigid, moldable or extrudable plastics.

Likewise, while individual clips 30 and continuous clips 40 are used in preferred embodiments of the novel roof recovers, the invention is not limited thereto. Other clip configurations may be used if desired. For example, while individual clips 30 in novel roof recover 10 are a unitary component, other individual clips suitable for use in other embodiments of the subject invention may have a two-piece design, similar to continuous clips 40. Likewise, continuous clip 40 may be fabricated as a unitary component, analogous to individual clips 30. The various flanges in the exemplified clips are integral with their associated clip body. If desired, however, the various flanges may be provided as separate components affixed to a clip body, e.g., by welding. Other suitable clip designs are known and may be used in the novel roof covers.

Figure 11:
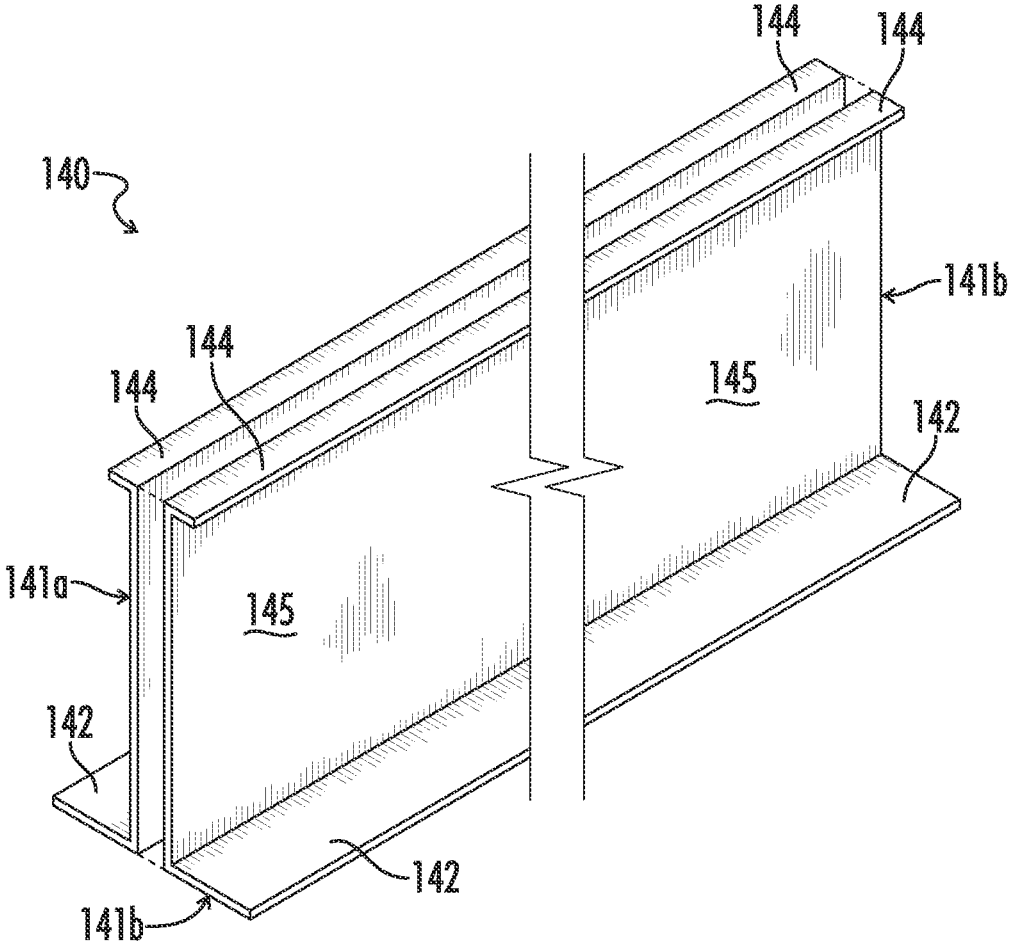
FIG. 11 is an isometric, slightly exploded view of a second continuous panel clip 140 that may be used in novel roof cover 10 shown in FIGS. 3-6.

For example, continuous clips 140 shown in FIG. 11 may be used in the novel cover systems. As may be seen therein, continuous clips 140 are formed from two identical components 141*a* and 141*b*. Clip components 141 have a generally C-shaped cross-section and are installed in back-to-back fashion such that the overall cross-section of continuous clips 140 is generally I-shaped. More particularly, clip components 141 have a bottom flange 142 and a top flange 144 extending generally horizontally from a vertically oriented web or body 145. Bottom flange 142 provides a base by which clips 140 may be attached to a roof support, for example, by driving screws into purlins 61. The screws typically are driven through base 142 to simplify installation of continuous clips 140. If desired, however, holes, slots or other apertures may be provided in base 142 to accommodate the passage of fasteners. The length of clip components 141, like continuous clips 40, is coordinated such that clips 140 span at least the distance between adjacent purlins 61, but preferably such that clips 140 extend across all purlins 61 in those zones of the roof in which they will be used. The width of base 142, as well as the placement, configuration, and number of any apertures present, preferably are coordinated to allow for some imprecision in placement of clip components 141 during installation while ensuring that a sufficient number of fasteners may be driven into existing purlins.

Top flanges 144 of continuous clips 140, similar to top flanges 44 in continuous clips 40, engage adjacent panels 20 and assist in the formation of a standing seam 21 therebetween. More particularly, top flanges 144 are configured such that sides 23 of panels 20 may be engaged therewith by slipping U-shaped channels 24 around top flanges 144. Seam cover 25 then is placed over and around channels 24 to secure panels 20 to each other and to continuous clips 140. Sealants and seamers also are preferably used to form a secure, weather tight seam along continuous clips 140.

Figure 12:
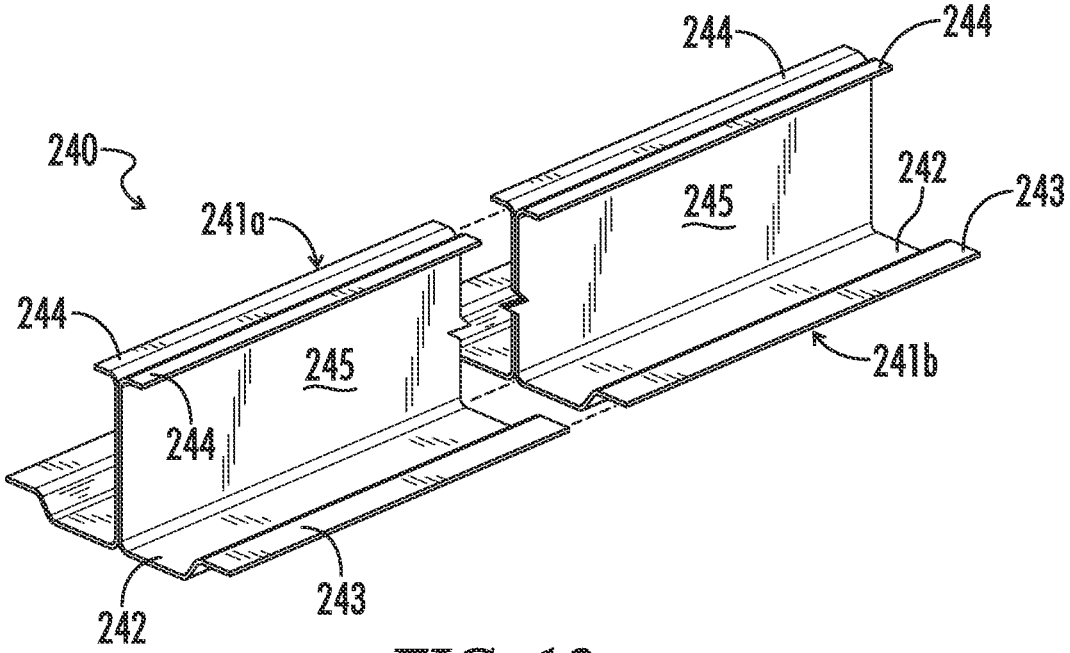
FIG. 12 is an isometric view of a third continuous panel clip 240 that may be used in novel roof cover 10 shown in FIGS. 3-6.
Figure 13:
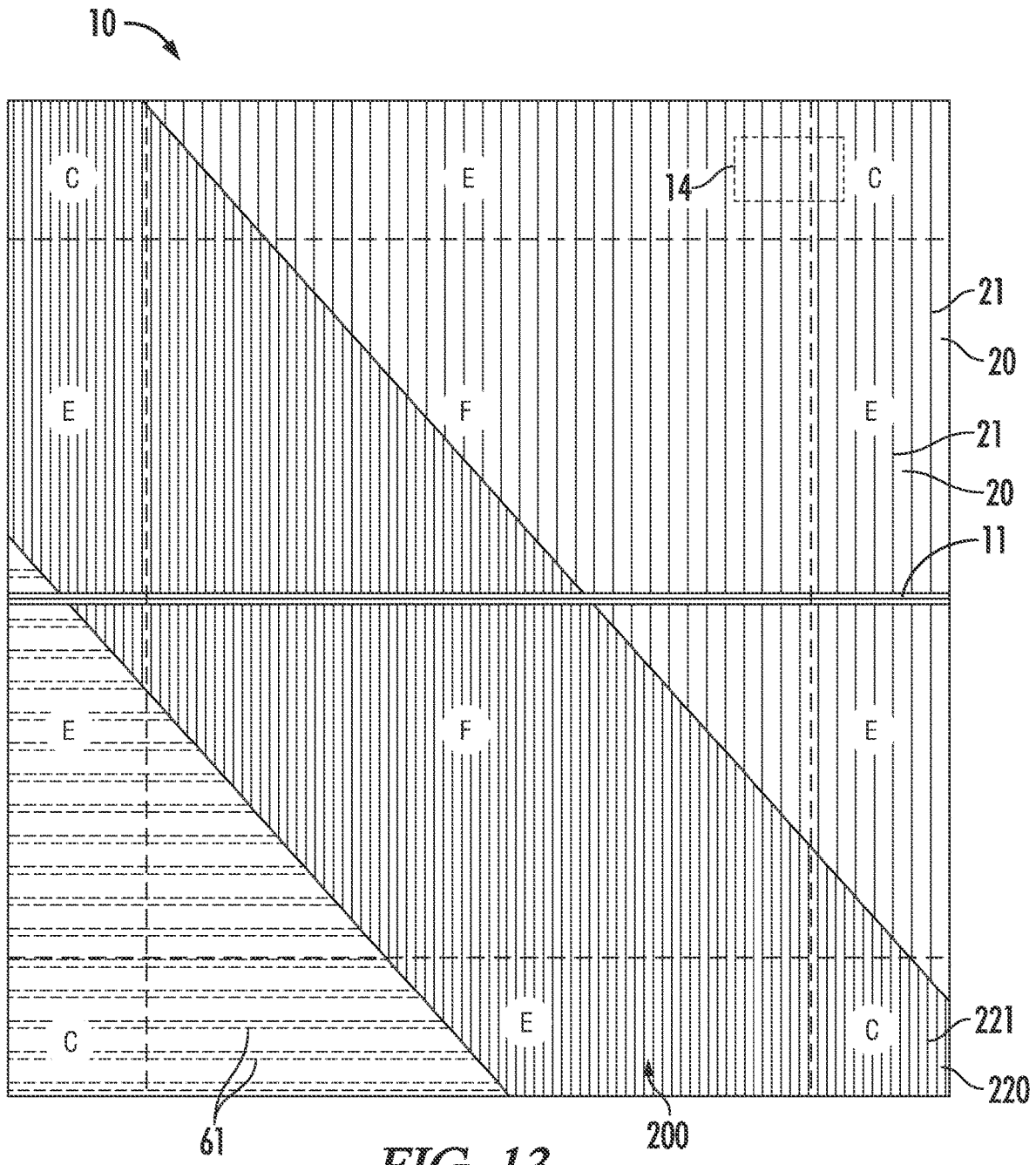
FIG. 13 is a top view, including partial tear-away views, of a conventional metal panel roof 200 which has been recovered with novel roof cover 10.

Continuous clips 240 shown in FIG. 12 also may be used in the novel cover systems. As shown there, continuous clips 240 are formed from two identical components 241*a* and 241*b*. Clip components 241 have a generally C-shaped cross-section and are installed in back-to-back fashion such that the overall cross-section of continuous clips 240 is generally I-shaped. More particularly, clip components 241 have a bottom flange 242 and a top flange 244 extending generally horizontally from a vertically oriented web or body 245. Bottom flange 242 provides a base by which clips 240 may be attached to a roof support, for example, by driving fasteners into purlins 62. Fasteners typically are driven through base 242 to simplify installation of continuous clips 240. If desired, however, holes, slots or other apertures may be provided in base 242 to accommodate the passage of fasteners.

Base 242 has an upwardly angled extending portion from which extends a horizontal shelf flange 243. Shelf flange 243, along with horizontally extending top flange 244, provides support for cover panels 20. Top flanges 244 also facilitate the formation of standing seams 21 between cover panels 20. As panels 20 are installed, sides 23 of panels 20 will be supported on shelf flanges 243 in adjacent lines of clips 240. At the same time, U-shaped channels 24 in the upper portion of sides 23 of panels 20 are slipped over top flanges 244. A seam cover 25 then is provided over and around the exterior of channels 24 to secure cover panels 20 to each other and to clips 240. Sealants and seamers also are preferably used to form a secure, weather tight seam along continuous clips 240.

Alternately, continuous support for panel seams across adjacent purlins may be provided by providing a panel support member which straddles two individual clips. The panel support member may be attached and secured to individual clips by any means known in the art, such as glue, welding, or fasteners. The panel support member includes a substantially flat upper surface and a bent flange on each edge of the substantially flat upper surface. The substantially flat upper surface of the panel support member is configured to contact and support the cover panel, for example, by engaging U-shaped channels in a manner analogous to that described above. The panel support member essentially connects the individual clips and creates a support structure for the cover panels.

Any of the wide variety of insulating materials commonly used in building construction to reduce heat transfer by conduction, radiation, or convection may be used in the novel metal roof covers. Such insulating materials include polyurethane, isocyanate, and other spray foam insulation, cotton, rock and slag wool, fiberglass, and other fibrous bats and blankets, cellulose and other blown-in fibrous insulation, and expanded or extruded closed cell polystyrene (EPS and XPS), polyisocyanate, and other rigid plastic foam insulation. Various barrier sheets, films, coatings, and facing also may be provided to provide additional thermal resistance, to minimize water condensation in the insulation, or to provide fire resistance to the insulation.

The choice of insulating materials will depend in large part on the degree of thermal resistance desired, cost considerations, and the supporting structure on which the cover in installed. For example, as exemplified by novel roof cover 10, when a cover is installed over purlins batts 51 of fiberglass or other fibrous materials commonly will be used. Batts 51 may be laid across the array of purlins 61 and clips 30 and 40 installed over batts 51. The height of clips 30 and 40 typically will be such that a small clearance, appropriate for the thickness of the batts used, will be provided between the bottom of panels 20 and the top flange 64 of purlins 61. The use and installation of batts and other insulation, as well as the use of thermally insulating supports, is well known may adapted or modified readily by workers in the art for use in the novel roof covers.

It also will be appreciated that the novel standing seam roof covers almost invariably require the use of other components to complete certain portions of a cover installation. For example, if the roof includes a number of different fields, ridge caps will be provided along the peak and hip lines of the cover, and specialized connectors may be required for their installation. Similarly, flashing may be installed in roof cover valleys and around projections through the roof. Facia and soffit components also may be installed along the eaves and gables of the roof. A wide variety of such components and installation methods are known in the art and may be used in the novel roof covers.

The novel panels in certain respects are similar to other standing seam roof panels as are conventionally used in metal panel roof covers. Thus, they may be fabricated from materials and by methods as are commonly employed in the art. Typically, such panels are fabricated from roll stock of painted or unpainted coated steel, such as Galvalume™ steel, zinc, copper, or aluminum. The roll stock is fed into a roll former which shapes the metal sheet into the desired configuration and cuts it to a desired length. The materials and fabrication of metal panels is well known in that art, and conventional materials and fabrication equipment may be used to manufacture the novel panels.

Novel roof cover 10 has been illustrated as being installed over a frame comprising an array of purlins 61. It will be appreciated, however, that the novel roof covers may be installed on a variety of support structures. They may be installed over a deck, for example, and some building owners may prefer a deck despite the increased cost. A deck provides additional support for the panels and also facilitates the use of foam insulation boards in the cover. Importantly, however, it is expected that the profile of sides 23 of panels 20 will allow them to be used as structural panels. That is, panels 20 will provide cover 10 with a sufficient degree of load-resistance to allow it to be installed on spaced purlins 61 as exemplified herein, especially when provided with one or more vertical ridges 26.

Sides 23 will be dimensioned accordingly. For example, for a panel having a width of 24 inches, the overall height of sides 23 will be from about 2.5 to about 3 inches, of which vertical portion 23*b* preferably is the major portion. Horizontal portions 23*c* and 23*d* will extend horizontally from about 0.5 to about 0.75, preferably about 0.625 inches. As exemplified, horizontal portion 23*d* may be somewhat shorter than horizontal portion 23*c* as that may help with inserting the top flanges of clips into the U-shaped channel 24. Angled portion 23*a* will extend at an angle of from about 30° to about 60°, more preferably from about 40° to about 50°, for example, at an angle of about 45°. Vertical ridges 26 have less dramatic profiles. For example, the width of vertical ridges 26 preferably will be from about 2 to about 3 inches while the height will be from about 0.1875 to about 0.375 inches. The overall height of sides 23 and the extension of horizontal portions 23*c* and 23*d* may be diminished somewhat for narrower panels and increased somewhat for wider panels. Likewise, the number and dimensions of vertical ridges 26 may be varied accordingly. Workers in the art, however, having the benefit of this disclosure will be able to optimize the specific dimensions of the profile to provide greater or less stiffness as may be required for a particular application.

As noted, using spaced purlins as a cover support typically allows the cover to be fabricated and installed at lower cost. The profile of panels 20 is expected to provide them with load-resistance comparable to conventional trapezoidal, standing seam structural panels such as panels 120, while providing them with other important advantages. As noted, panels 20 are symmetrical panels whereas panels 120 are asymmetrical panels. Thus, installation of panels 20 may proceed in either direction, and if damaged after installation in roof cover 10, individual panels 20 can be replaced without removing any adjacent panels 20. Asymmetrical panels 120 must be installed in a specific direction—either from left-to-right or right-to-left. Moreover, if a panel 120 is damaged and must be replaced, it must be reached by uninstalling panels 120 in the direction opposite to the direction in which they were installed. Thus, it may be necessary to uninstall and reinstall many undamaged panels 120 to replace a damaged panel 120.

Moreover, the profile of panels 20 is simpler and allows them to be formed on smaller, less capable roll formers that can be transported to a job site. Because they can be formed on site, in most cases they can be run in lengths sufficient to cover the entire slope of the roof. Prior art panels 120, however, because of their more complicated profile, require larger, more capable roll formers that are not easily transported to a job site. Thus, they must be fabricated in the factory and cut to transportable lengths. More often than not, those lengths are not sufficient to cover the entire slope of the roof. Multiple panels must be end lapped together to complete a run, and those end laps are potential sources of leading and are more susceptible to wind uplift.

Finally, it will be appreciated that proper modularity may be more easily maintained as the novel triangular standing seam panels are installed. Because of their profile, they do not tend to flex, accordion-like, in and out of their specified widths as do prior art trapezoidal standing seam panels. Moreover, prior art asymmetrical trapezoidal standing seam panels must be installed in a specific sequence, either left-to-right or right-to-left, and their profile requires that the clips be installed more or less at the same time that the panel is laid down. A modularity gauge typically must be employed to minimizes lateral flexing as the clips are installed. The novel triangular standing seam panels, however, are symmetrical. Their clips may be installed before the panels are laid down and seamed. Because the clips may be installed with precision, their placement helps maintain modularity of the novel panels as they are installed without the need for a modularity gauge.

The novel roof covers also may be installed over an existing roof cover. For example, as shown in FIGS. 13-16, novel roof cover 10 may be installed over a prior art metal roof 200. Existing roof 200 is typical of exposed fastener metal roofs that have been installed in great numbers over the past few decades. As shown generally therein, it includes an array of spaced, elongated bar joists or purlins 61. Purlins 61 are mounted on structural rafter beams (not shown) of a roof substructure and run horizontally through the roof.

Figure 14:
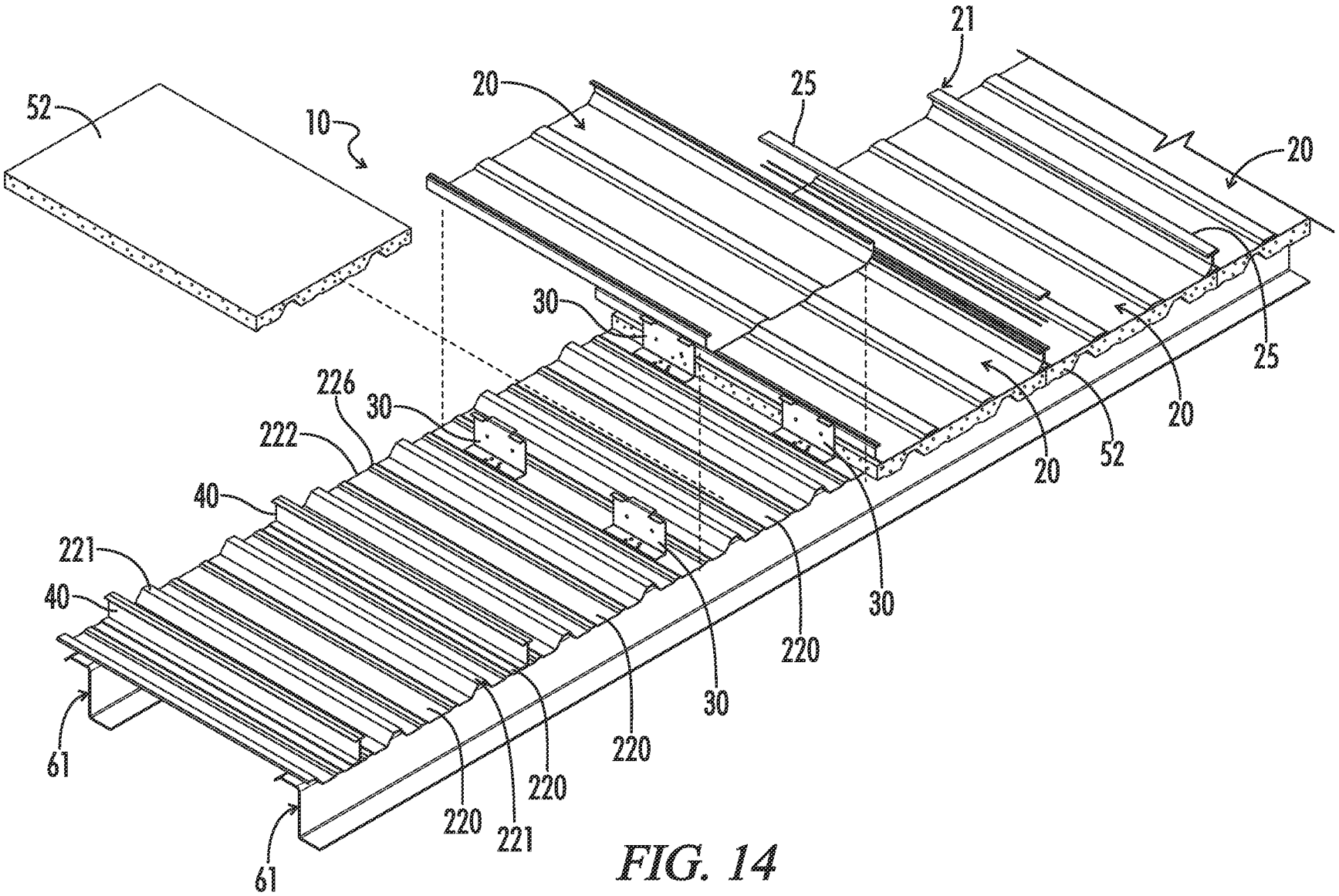
FIG. 14 is an isometric, partially exploded view of a portion of novel roof cover 10 installed over existing roof 200 taken generally from an area 14 of FIG. 13, which portion has been installed across a boundary between edge zone E and corner zone C of existing roof 200 (certain components of novel roof cover 10 having been omitted therefrom to better show underlying components).
Figure 15:
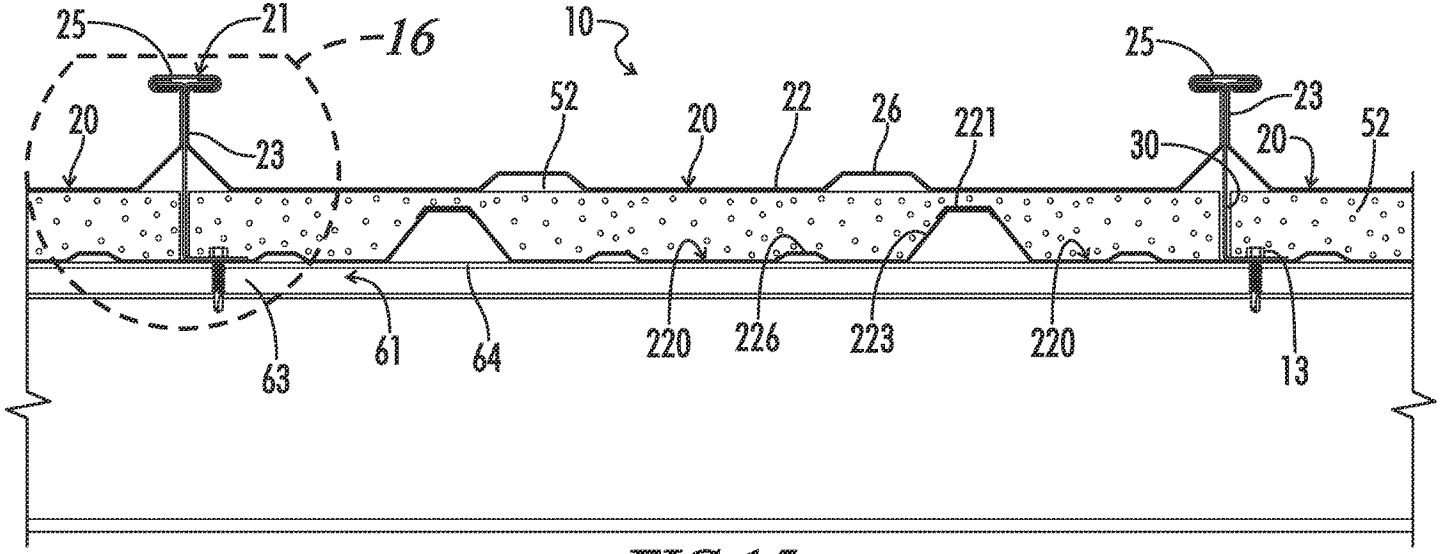
FIG. 15 is a cross-sectional view, taken generally perpendicular to standing seams 21 of novel roof cover 10 shown in FIGS. 13-14.
Figure 16:
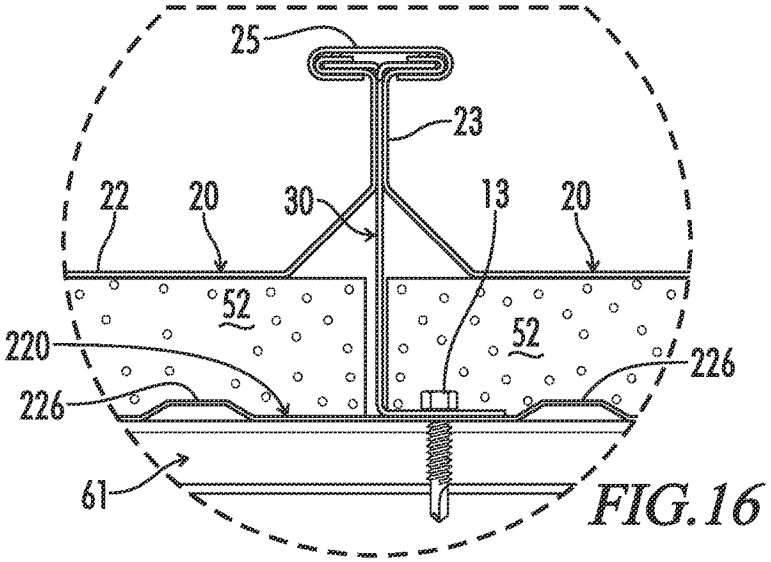
FIG. 16 is an enlarged, detailed view of portion 16 of the view shown in FIG. 15.

As best seen in FIGS. 14-16, panels 220 in existing roof 200 run vertically across purlins 61 and have upturned longitudinal sides that overlap to form raised lap ridges 221. Existing panels 220 also have, as is typical of panels of this type, a number of vertical ridges 226 formed in the trough 222 extending between lap ridges 221. Panels 220 are supported by and attached to upper flange 64 of purlins 61 by penetrating fasteners, such as screws (not shown), which are installed in the troughs 222 of panels 220. Panels 220 also are interconnected by screws or other penetrating fasteners (not shown) installed along overlapping lap ridges 221.

Roof cover 10 is installed over existing roof 200 in a manner similar to the original installation of roof cover 10 exemplified above. Panel clips 30 and 40, however, are arranged on the surface of existing panels 200, and the fasteners, such as metal screws 13, are driven though existing panels 220. If desired, panels 220 of existing roof 200 may be further secured to purlins 61 or other support members with additional fasteners before installing roof cover 10.

Preferably, clips 30 and 40 also are made somewhat taller to allow, as shown in FIGS. 14-16, the installation of foam board insulation 52 between existing panels 220 and panels 20. Foam boards 52 have a generally flat, solid rectangular configuration such that they may be placed over existing panels 220 between adjacent rows of clips 30 and 40 with their sides closely abutting each other. The bottom surface of foam board 52 preferably is profiled to mate more or less with the profile of existing panel 220. The bottom surface of foam boards 52, therefor, will be able to rest more or less continuously across the surface of existing panels 220, thus allowing any load transmitted to the foam to be distributed across a wider area. When foam boards 52 will be installed in areas where individual clips 30 are present, cutouts may be provided (not shown), if desired, to accommodate individual clips 30 and facilitate installation of foam boards 52. Wider foam boards spanning across seam lines also may be provided with openings to accommodate individual panel clips.

Foam boards 52 preferably are composed of relatively dense high load capacity rigid plastic foam, such as expanded or extruded closed cell polystyrene. They may comprise facing, such as various barrier sheets, films, and coatings designed to provide a vapor barrier, to reflect radiant heat, or to provide fire resistance, or they may be unfaced. Typically, foam boards 52 will have a load capacity of from about 18 to about 25 pounds per square inch (psi).

It will be appreciated, however, that the novel roof covers may be installed over existing roof covers of various types in a variety of ways, and many conventional methods are known. For example, the novel roof covers may be installed over standing seam metal panel roof covers in a manner similar to recover systems disclosed in U.S. Pat. No. 8,938,924 to C. Smith. They may be installed over shingled roof covers in a manner similar to recover systems disclosed in U.S. Pat. No. 9,404,262 to C. Smith. Other methods are known and may be used. Moreover, although illustrated as being installed over an uninsulated existing roof cover, the novel roof covers may be installed of insulated roof covers.

Similarly, and as well understood by workers in the art, though referred to a "roof" panels, the novel panels and cover systems may use used to cover other surfaces of structures. If desired, for example, they may be used to cover walls of a building.

Finally, and for the avoidance of doubt, it will be appreciated that the terms "horizontal" and "vertical," and forms thereof, have been used in two senses. In first senses, as applied to the orientation and layout of components within a cover system, the terms are understood in reference to the slope of the roof. "Horizontal" denotes that the component is oriented or runs across the slope of the roof, while "vertical" denotes that it is oriented or runs along the slope. In second senses, the terms are understood in reference to the plane of the roof, "horizontal" denoting extension in or generally parallel to the plane and "vertical" denoting extension generally perpendicular to the plane. Workers in the art commonly use the terms in both senses and will readily discerns the sense in which they are used in this disclosure.

While this invention has been disclosed and discussed primarily in terms of specific embodiments thereof, it is not intended to be limited thereto. Other modifications and embodiments will be apparent to the worker in the art.

What is claimed is:

1. A standing seam metal panel for a roof cover system, said metal panel comprising:

(a) upstanding symmetrical sides defining lateral edges; and (b) a trough extending between said lateral edges;

(c) wherein each said lateral edge comprises:

i) an angled portion extending upward and outward from said trough;

ii) a vertical portion extending upward from said angled portion and generally perpendicular to said trough;

iii) a first horizontal portion extending inward from said vertical portion and generally parallel to said trough; and iv) a second horizontal portion extending above, outward from, and generally parallel to said first horizontal portion; and (d) wherein said lateral edges:

i) are formed by bends in said metal panel defining said portions of said lateral edges; and ii) are adapted to form a sidelap with a said lateral edge of an adjacent said metal panel in said cover system, said sidelap being formed on panel clips of said cover system.

2. The metal panel of claim 1, wherein said lateral edge angled portion extends from said trough at an angle of from about 30 to about 60°.

3. The metal panel of claim 1, wherein said lateral edge angled portion extends from said trough at an angle of about 45°.

4. The metal panel of claim 1, wherein said first and second lateral edge horizontal portions are doubled over to form a U-shaped channel adapted to receive a support portion of said panel clips of said cover system.

5. The metal panel of claim 1, wherein said metal panel comprises a ridge running longitudinally through said trough.

6. The metal panel of claim 5, wherein said metal panel comprises two or more said ridges.

7. A standing seam metal panel roof cover system, said cover system comprising:

(a) a plurality of panel clips attached to a support and arranged in linear arrays running along a pitch of said cover system; and (b) a metal panel cover attached to said panel clips, said metal panel cover comprising a plurality of said metal panels of claim 1, said plurality of said metal panels being interconnected along adjacent said lateral edges by sidelaps formed on said panel clips, said sidelaps extending along the pitch of said cover system.

8. The cover system of claim 7, wherein said cover system comprises an array of spaced purlins providing said support, said purlins running across the pitch of said cover system and said plurality of panel clips being attached to said purlins.

9. The cover system of claim 7, wherein said cover system comprises insulation disposed between said support and said metal panel cover.

10. The cover system of claim 7, wherein said panel clips are continuous panel clips.

11. The cover system of claim 7, wherein said panel clips include individual panel clips installed in a field zone of said cover system and continuous panel clips installed in an edge zone or a corner zone of said cover system.

12. A metal panel standing seam roof recover system installed over an existing cover of a roof cover system, said recover system comprising;

(a) a plurality of panel clips attached to said existing cover system and arranged in linear arrays running along a pitch of said roof recover system; and (b) a metal panel recover attached to said panel clips, said metal panel recover comprising a plurality of said metal panels of claim 1, said plurality of said metal panels being interconnected along adjacent said lateral edges by sidelaps formed on said panel clips, said sidelaps extending along the pitch of said recover system.

13. The recover system of claim 12, wherein said recover system comprises rigid foam insulation boards disposed between said existing cover system and said metal panel recover.

14. The recover system of claim 12, wherein said existing cover system is a metal panel cover system.

15. The recover system of claim 12, wherein:

(a) said existing cover system comprises a support frame having an array of spaced purlins running across the pitch of said existing cover system; and (b) said plurality of panel clips are attached to said purlins.

16. The recover system of claim 12, wherein said panel clips include individual panel clips installed in a field zone of said existing cover system and continuous panel clips installed in an edge zone of said existing cover system.

17. The recover system of claim 12, wherein said panel clips include individual panel clips installed in a field zone of said existing cover system and continuous panel clips installed in a corner zone of said existing cover system.

18. A method of installing a standing seam metal panel roof cover system, said method comprising:

(a) installing a plurality of panel clips on an array of spaced purlins running across a pitch of said cover system, said plurality of panel clips being installed in linear arrays running along the pitch of said cover system; and (b) attaching a plurality of said metal panels of claim 1 to said panel clips by forming said sidelaps on said panel clips.

19. The method of claim 18, wherein said panel clips are continuous panel clips.

20. The method of claim 18, wherein said method comprises:

(a) installing individual panel clips in a field zone of said cover system; and (b) installing continuous panel clips in an edge zone or a corner zone of said cover system.

* * * * *